US007481148B2

(12) United States Patent
Rosvall

(10) Patent No.: US 7,481,148 B2
(45) Date of Patent: Jan. 27, 2009

(54) DEVICE FOR TRANSFERRING PROJECTILE INTO BARREL OF WEAPON

(75) Inventor: Pauli Rosvall, Huittinen (FI)

(73) Assignee: Patria Weapon System Oy, Vammala (FI)

( * ) Notice: Subject to any disclaimer, the term of this patent is extended or adjusted under 35 U.S.C. 154(b) by 0 days.

(21) Appl. No.: 11/795,834

(22) PCT Filed: Feb. 14, 2006

(86) PCT No.: PCT/FI2006/050064

§ 371 (c)(1),
(2), (4) Date: Jul. 23, 2007

(87) PCT Pub. No.: WO2006/087425

PCT Pub. Date: Aug. 24, 2006

(65) Prior Publication Data

US 2008/0110325 A1 May 15, 2008

(30) Foreign Application Priority Data

Feb. 15, 2005 (FI) ..... 20055067

(51) Int. Cl.
*F41A 9/00* (2006.01)

(52) U.S. Cl. ..... 89/47; 89/45

(58) Field of Classification Search ..... 89/1.801, 89/1.805, 33.05, 45, 47
See application file for complete search history.

(56) References Cited

U.S. PATENT DOCUMENTS

2007/0113732 A1* 5/2007 Spork et al. ..... 89/45

FOREIGN PATENT DOCUMENTS

| | | |
|---|---|---|
| DE | 161869 | 7/1905 |
| SE | 514 605 | 3/2001 |

* cited by examiner

*Primary Examiner*—Stephen M Johnson
*Assistant Examiner*—Daniel J Troy
(74) *Attorney, Agent, or Firm*—Ladas & Parry

(57) ABSTRACT

A transfer device for pushing a projectile (3) into the barrel of a weapon in the direction of the barrel (1) of the weapon along a transfer trough (2). The transfer device has two turning wheels (5, 6), a flexible power transmission element (7) forming a closed loop, and two transfer elements (8, 10) mounted to push the projectile (3) in consecutive steps towards the barrel (1) of the weapon.

8 Claims, 3 Drawing Sheets

DEVICE FOR TRANSFERRING PROJECTILE INTO BARREL OF WEAPON

FIELD OF THE INVENTION

The invention relates to a transfer device for pushing a projectile into the barrel of a weapon along a transfer trough that is located behind the barrel at least during the transfer and positioned substantially parallel to the barrel, the transfer device having an elongate power transmission element that during the transfer of the projectile moves at least along part of its length substantially parallel to the transfer trough toward the barrel of the weapon, and at least one transfer element that under the influence of the moving power transmission element pushes the projectile from behind toward the barrel of the weapon.

BACKGROUND OF THE INVENTION

In various medium-heavy or heavy weapons or cannons and mortars, transferring the projectile to the barrel of the weapon is difficult. Especially handling heavy projectiles manually is both slow and dangerous. The aim is more and more to use semi-automatic or automatic operation, in which the projectiles are stored in different cartridges and moved from the cartridges with separate transfer equipment to the orifice of the barrel of the weapon, from where they are then transferred mechanically by pushing with a transfer device into the barrel. Devices of this type are known from U.S. Pat. No. 4,481,862, for instance.

During firing, the barrel of a weapon usually moves backward due to recoil, and this matter needs to be taken into consideration when designing the transfer equipment, its position and operation. Further, the breech mechanism, with which the back end of the barrel is closed during firing, requires its own space, and transfer devices need to be able to transfer the projectile at one go sufficiently far into the cartridge housing.

There are also risks involved in handling projectiles and, therefore, a projectile must not be rattled or subjected to very sudden accelerations.

BRIEF DESCRIPTION OF THE INVENTION

It is an object of the present invention to provide a transfer device with which the transfer of a projectile, after it is brought behind the barrel of a weapon in a coaxial position with the barrel, is efficient and smooth and takes place with a substantially even movement without sudden stops or accelerations during the transfer movement.

The transfer device of the invention is characterised in that it has two turning wheels at a distance from each other, that the power transmission element is a flexible element forming a closed loop and mounted to run around the turning wheels, that it has two transfer elements mounted to push a projectile in consecutive steps toward the barrel of a weapon, that the power transmission element has two connecting elements at a distance from each other, which alternately engage to move first the first transfer element and then the second transfer element, that the first transfer element is always in a position in which it extends behind the projectile and moves it first a part of the way, while the second transfer element is in a position in which it is at the side of the projectile and disengaged from the power transmission element, that when the first transfer element is in the predefined position, the second transfer element engages the power transmission element and turns behind the projectile, that after this the first transfer element decelerates and the second transfer element continues to push the projectile into the barrel of the weapon after the pushing movement of the first transfer element ends.

An essential idea of the invention is that to achieve a sufficient transfer distance, the projectile is moved by two transfer elements operated with an endless power transmission element so that the first transfer element moves the projectile a part of the way and the second transfer element pushes the projectile the rest of the transfer distance. A further essential idea of the invention is that the transfer elements engage to push the projectile so that the second transfer element starts to push the projectile from behind before the first transfer element stops moving the projectile, in which case the change of transfer element does not substantially cause any stops or decelerations or accelerations for the projectile during the transfer movement.

The invention provides the advantage that the projectile is moved from its initial position to the barrel of the weapon substantially evenly and smoothly, and the transfer equipment can also be made reasonably short with respect to the required transfer distance. A further advantage of the invention is that it is relatively simple to implement and very reliable to operate.

BRIEF DESCRIPTION OF THE FIGURES

The invention is described in more detail in the attached drawings, in which.

DETAILED DESCRIPTION OF THE INVENTION

Figure 1A:
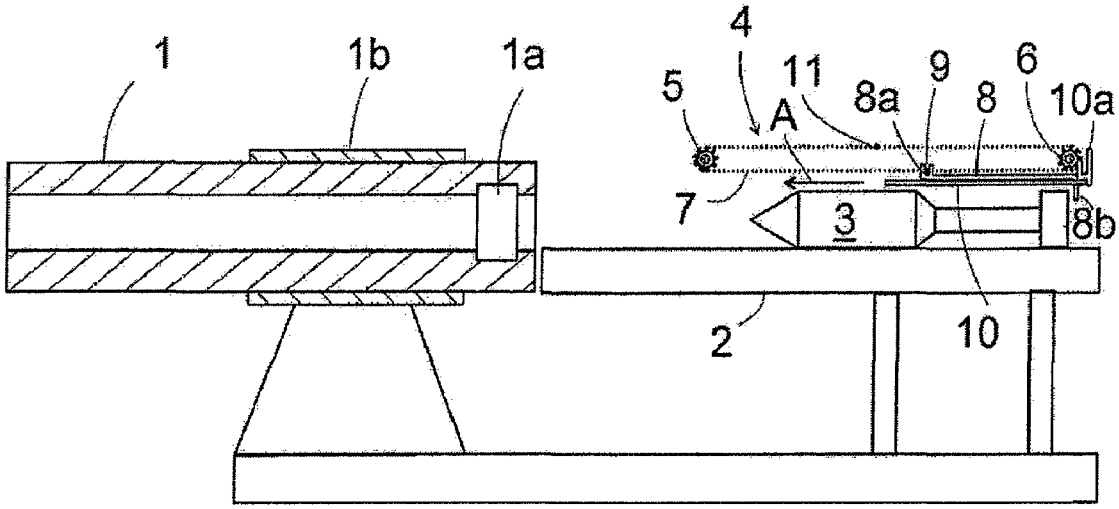
FIGS. 1*a* to 1*d* are schematic views of the barrel of a weapon, a transfer device, and a projectile before it is transferred to the barrel of the weapon, the transfer steps of the projectile and, correspondingly, the projectile after it is in place in the barrel of the weapon.
Figure 1B:
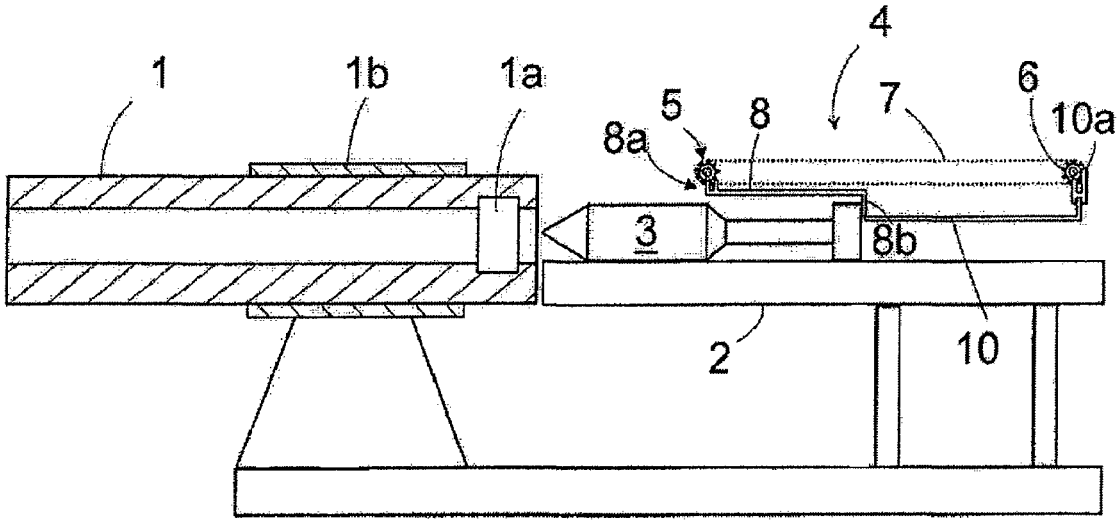
Figure 1C:
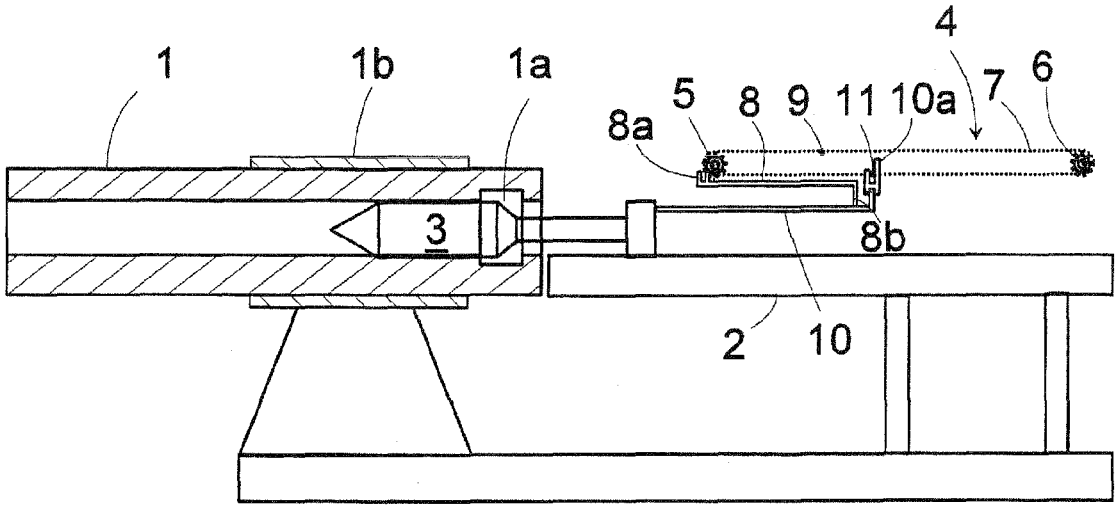
Figure 1D:
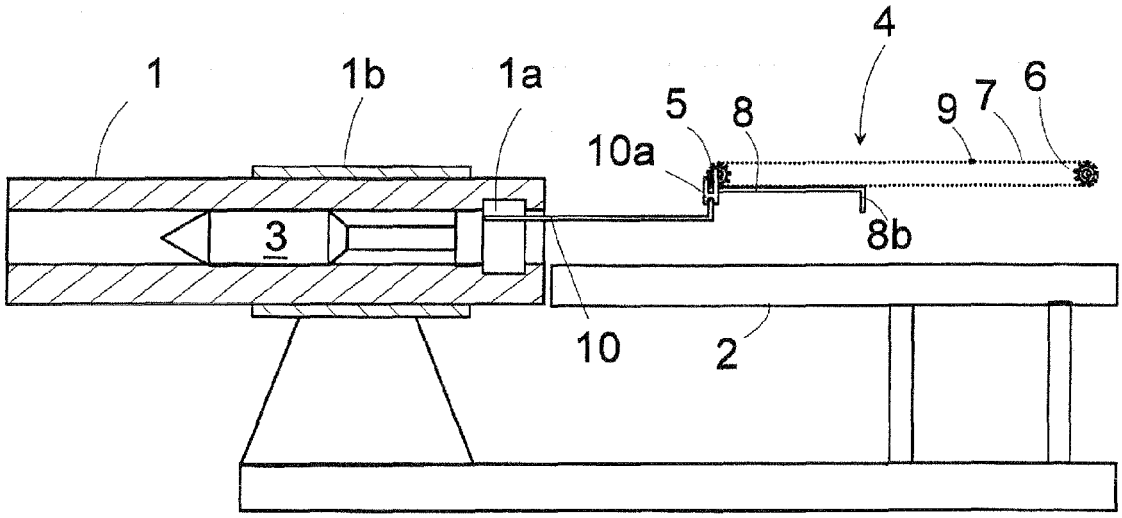

FIG. 1*a* is a partly cross-sectional schematic view of the end of a barrel 1 of a weapon, where the breech mechanism is. Weapons of this type may be either cannons or mortars of different caliber. By way of example, grooves are marked at the furthest end of the barrel 1 to show the position of a housing 1*a* of the breech block (not shown) relative to the barrel 1. Several different breech mechanisms and types are used in different weapons. It is not necessary to describe them separately herein, because they are known per se to a person skilled in the art and not essential per se for this invention. Around the barrel 1, several weapons have a cradle 1*b*, and the barrel 1 can move in a manner known per se in its longitudinal direction backward due to recoil from firing, and return by means of separate known returning devices (not shown) back to its firing position. Further, FIG. 1*a* shows a transfer trough 2 with a transfer-ready projectile 3 resting on it. The projectile 3 is substantially coaxial with the barrel of the weapon so that when it is moved along the transfer trough 2, it goes straight into the barrel. It further has a transfer device 4 with which the projectile is transferred by pushing it from behind in a manner described later in FIGS. 1*b* to 1*d*. FIGS. 1*b* to 1*d* show schematically how the projectile 3 is moved with the transfer device 4 into the barrel 1 of the weapon. In the situation of FIG. 1*a*, the projectile 3 is moved to or set on the transfer trough 2 to wait for transfer into the barrel 1 of the weapon. The transfer device 4 has turning wheels 5 and 6, i.e. in this embodiment chain wheels, at a distance from each other, and an endless power transmission element 7, in this embodiment a chain, is arranged to run around them. A first transfer element 8 is connected to the power transmission element 7. The transfer element 8 is an elongate element that has at one end, i.e. in the case of FIG. 1*a* in the leftmost end, a slot-like connection part 8*a* and at the opposite end a pin-like pulling part 8*b* extending behind the back part of the projectile. The power transmission element 7 has a connection element 9 that extends to the slot of the slot-like part 8*a* and is, by way of example, a pin transverse to the longitudinal direction of the power transmission element 7. As the power transmission element moves during the transfer of the projectile 3 in direction A, it simultaneously pulls the first transfer element 8 with it, and consequently the transfer element 8 acts on the back part of the projectile 3 with the pulling part 8*b* and moves the projectile toward the barrel 1 of the weapon.

The transfer device 4 further has a second transfer element 10 with a slot-like connection part 10*a* at one end, i.e. in the solution of FIGS. 1*a* to 1*d*, the rightmost end. The second transfer element 10 is connected to the connection part 10*a* to turn around the longitudinal axis of the transfer element 10 so that, when the projectile 3 is in the position of FIG. 1*a*, it is turned away from the path of the projectile 3, in the case of FIG. 1*a*, it is turned above it. The position and location of the second transfer element 10 relative to the projectile 3 may be different depending on what position the transfer device 4 is relative to the projectile 3. In the figures, the transfer device 4 is, by way of example, shown above the projectile only for illustrative reasons, and it may be located above or below the projectile or at its side at different points.

A second connection element 11 is connected to the power transmission element 7, in this case, it is by way of example a pin transverse to the longitudinal direction of the power transmission element 7 and, when the power transmission element moves in the direction of arrow A, it initially moves in the opposite direction with the power transmission element 7 and, when turning around the turning wheel 6, it settles into the slot of the connection part 10*a* and then starts to move the second transfer element 10 to the direction of arrow A.

FIG. 1*b* shows a situation, in which the projectile 3 has been moved toward the barrel 1 of the weapon part of the way. In this situation, the first transfer element 8 still moves with the power transmission element 7 at the same speed and pushes the projectile toward the barrel 1. The second transfer element 10 has correspondingly turned behind the back part of the projectile 3 and also moves at the same speed with the power transmission element 7. Now the speed of the first transfer element 8 begins to slow, because the movement speed component of the power transmission element 7 in the direction of arrow A begins to decrease as the power transmission element turns upward along the circumference of the turning wheel 5. At the same time as the transfer element 8 begins to fall behind the projectile, the second transfer element 10 moves at the same speed with the power transmission element 7 and continues to push the projectile 3 toward the barrel 1 of the weapon without any substantial speed change, deceleration or acceleration in the movement of the projectile when the transfer element changes, and the connection from the action of the first transfer element to the action of the second transfer element is smooth.

In the situation of FIG. 1*c*, the first transfer element 8 has already fallen behind and nearly stopped, while the second transfer element 10 has continued to push the projectile 3 forward.

In the situation of FIG. 1*d*, the projectile 3 is in the barrel 1 of the weapon on the other side of the housing 1*a*, when the second transfer element 10 extends over the housing 1*a* and recoil movement measurement of the barrel 1 to the inside of the barrel. The first transfer element waits in the position shown in FIG. 1*d* that the power transmission element 7 is engaged to move in the opposite direction to the direction of arrow A. The power transmission element 7 then first pulls the second transfer element 10 backward. During the return movement, when the transfer elements 8 and 10 and power transmission element 7 are in a situation corresponding to FIG. 1*c*, the connection element 9, i.e. pin, turns with the power transmission element around the turning wheel 5 to the slot of the slot-like connection part 8*a* and begins to move the first transfer element 8 backward, i.e. to the right in FIGS. 1*a* to 1*d*. As the second transfer element 10 comes to the position corresponding to FIG. 1*b* during the return movement, a separate guide mechanism turns the second transfer element 10 away from the projectile 3 to the position shown in FIG. 1*a*.

In an embodiment of the invention according to FIGS. 1*a* to 1*d*, the transfer device 4 can be installed in a fixed position relative to the weapon, in which case the recoil movement of the barrel of the weapon must be taken into consideration when determining the relative positions of the transfer device 4 and barrel 1 of the weapon.

Figure 2A:
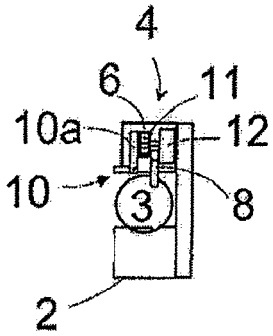
FIGS. 2*a* and 2*b* are schematic views of the transfer device and the position of the transfer elements in the loading situation of FIGS. 1*a* to 1*d*, as seen from behind the projectile.
Figure 2B:
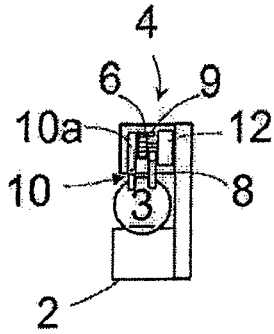

FIG. 2*a* is a view of the transfer device and projectile in a situation corresponding to FIG. 1*a*, as seen from behind the projectile. As FIG. 2*a* shows, the second transfer element 10 is turned above the projectile 3, and the pulling part 8*a* of the first transfer element 8 extends behind the projectile 3 so that it can push the projectile 3. FIG. 2*b*, in turn, is a view of situations according to FIGS. 1*b* to 1*d*, as seen from behind the projectile. They show how the second transfer element 10 is turned downward so that it coincides with the back part of the projectile 3 and can push the projectile 3 forward. FIGS. 2*a* and 2*b* also schematically show a motor 12 that turns the turning wheel 6 and thus moves the power transmission element 7. The motor can be any suitable motor, such as a hydraulic, pneumatic, or electric motor depending on the application.

Figure 3A:
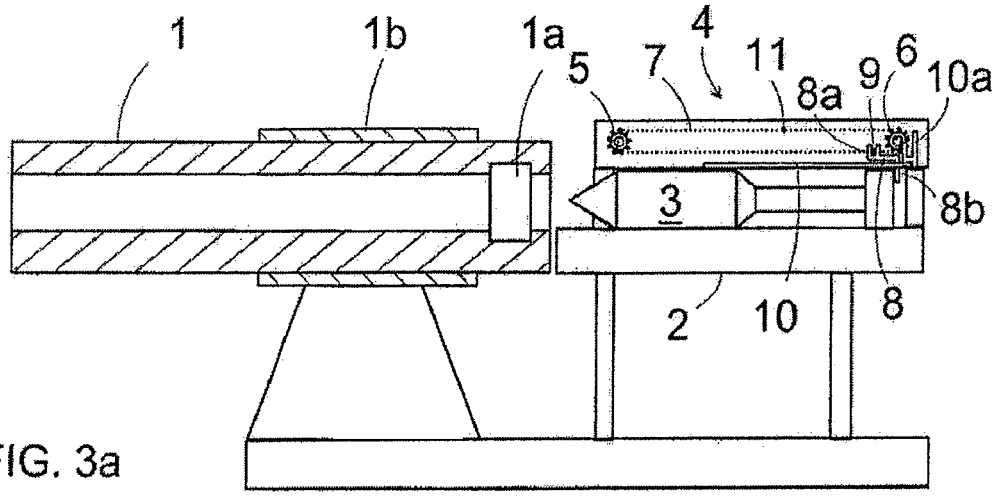
FIGS. 3*a* to 3*b* are schematic views of a second embodiment of the transfer device of the invention before the projectile is transferred into the barrel of the weapon, and, correspondingly, the projectile after it is in place in the barrel of the weapon.
Figure 3B:
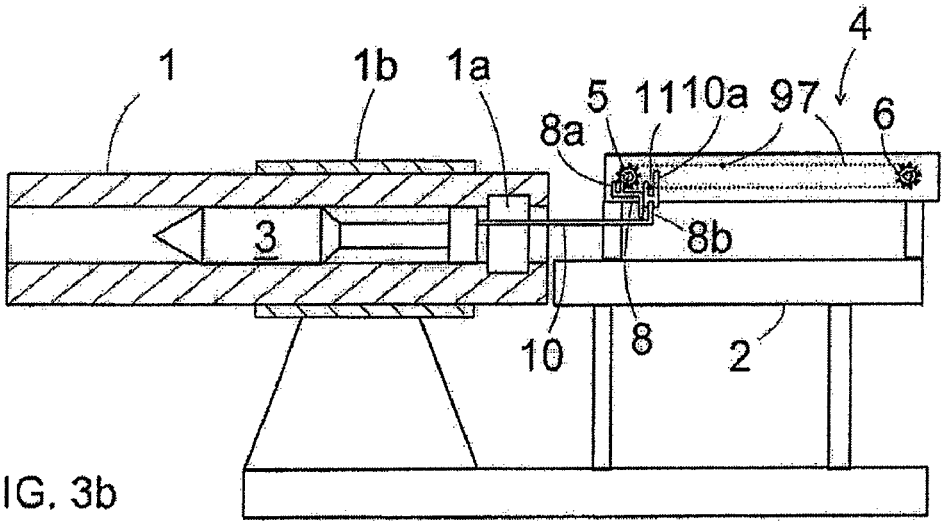

FIGS. 3*a* and 3*b* are schematic views of another embodiment of the transfer device of the invention. The starting point in this embodiment is that the transfer device 4 is separately turned or moved in transverse direction to the barrel 1 into the projectile transfer position, when the projectile is transferred to the barrel of the weapon, and, correspondingly, after the transfer, it is moved away from behind the barrel of the weapon. The recoil movement of the barrel then need not be taken into account, and the length of the transfer device 4 and its transfer elements can be dimensioned differently so that the total length becomes smaller than in the embodiment shown in FIGS. 1*a* to 1*d*. In this embodiment, the components of the transfer device 4 are the same and, thus, they are also numbered the same. The only visible difference is that the length of the power transmission element 7, and thus also the distance between the turning wheels 5 and 6, for instance chain wheels or cogwheels, is smaller than in the previous embodiment. Correspondingly, the first transfer element 8 is significantly shorter than in the previous embodiment. Otherwise the operation of this embodiment corresponds fully to the embodiment shown in FIGS. 1*a* to 1*d*. Different turning mechanism of this type, linear transfer mechanisms, such as rails and other sliding structures, are known per se, and their application in this situation is apparent in accordance with the embodiment.

The turning of the second transfer element 10 in the initial position, i.e. the situation shown in FIG. 1*a* and 3*a*, respectively, away from the projectile 3 can be implemented in different ways. At its simplest, it can be done in such a manner that only the second transfer element is pivoted to turn around the longitudinal axis, and the transferring of the projectile from the side to the transfer trough 2 pushes the second transfer element aside. A result of this is, of course, that the second transfer element 10 drags along the side of the projectile 3 during the first transfer step, but this is not significant. Another alternative is that the second transfer element 10 is during its return movement directed by force to turn aside with different pin surfaces or other protruding guide surfaces or guides, for instance. Correspondingly, the turning of the second transfer element away from the pushing position is prevented during the transfer of the projectile for the reliability of the transfer movement and for safety's sake. This can be implemented for instance by using a guiding groove along the entire travel distance of the second transfer element, in which the transverse section of the turning part runs during the entire movement. The groove can then be made curved at the turning wheel 6 side end so that it forces the second transfer element to turn aside from the pushing position. Guides and mechanisms of this type are generally used in the art and obvious to a person skilled in the art and, therefore, need not be described in more detail herein. Instead of a chain, the power transmission element can be a wire or cogged belt, and instead of the chain wheels, cogged band pulleys, grooved pulleys or corresponding components can be used.

The invention claimed is:

1. A transfer device for pushing a projectile into the barrel of a weapon along a transfer trough (2) that is located behind the barrel at least during the transfer and positioned substantially parallel to the barrel, the transfer device having two turning wheels (5, 6) at a distance from each other and an elongate power transmission element (7) that is a flexible element forming a closed loop and mounted to run around the turning wheels (5, 6) and that during the transfer of the projectile moves at least along part of its length substantially parallel to the transfer trough (2) toward the barrel of the weapon, and at least two transfer elements (8, 10) that under the influence of the moving power transmission element (7) push the projectile (3) from behind in consecutive steps toward the barrel of the weapon, whereby the first transfer element (8) is always in a position, in which it extends behind the projectile (3) and moves the projectile (3) first a part of the way, while the second transfer element (10) is in a position in which it is at the side of the projectile (3) and disengaged from the power transmission element (7), and when the first transfer element (8) is in a predefined position, the second transfer element (10) engages the power transmission element (7) and turns behind the projectile (3) to push it, characterised in that the power transmission element moves in one direction during the transfer of the projectile, that the power transmission element (7) has two connection elements (9, 11) at a distance from each other, and the first connection element (9) is engaged to move the first transfer element (8), and after the first transfer element (8) has moved the projectile (3) a part of the way, the second connection element (11) engages to move the second transfer element (10) at the same speed in the same direction, that the second transfer element (10) starts to push the projectile (3) from behind before the first transfer element (8) stops moving the projectile (3), that, after this, the movement speed of the of the first transfer element (8) decelerates and the second transfer element (10) continues to push the projectile (3) into the barrel of the weapon as the pushing movement of the first transfer element (8) ends.

2. A transfer device as claimed in claim 1, characterised in that the turning wheels (5, 6) are chain wheels, and the power transmission element (7) is a chain.

3. A transfer device as claimed in claim 1, characterised in that the turning wheels (5, 6) are cogwheels, and the power transmission element (7) is a cogged belt.

4. A transfer device as claimed in claims 1, characterised in that each transfer elements (8, 10) has a slot-like connection part which in the second transfer element (10) is at its back end, that the power transmission element (7) has for each transfer element (8, 10) pin-like connection elements at a distance of at most the distance between the axes of the turning wheels (5, 6) and extending to the slot of the connection part, which during the transfer movement are located at least part of the time on the same side of the power transmission element (7) relative to the turning wheels (5, 6) and during the start and end of the transfer movement on opposite sides.

5. A transfer device as claimed in claim 4, characterised in that the connection element of the first transfer element (8) located in the power transmission element (7), when turning around the barrel side turning wheel (5), moves out of the slot of the connection part of the first transfer element (8), whereby the movement of the first transfer element (8) begins to slow at the begin of the turn and finally stops altogether.

6. A transfer device as claimed in claim 4, characterised in that when the first transfer element (8) is in said predefined position, the connection element of the second transfer element (10) located in the power transmission element (7), when turning around the turning wheel (6) furthest away from the barrel of the weapon, moves into the slot of the connection part of the second transfer element (10) and stairs to move the second transfer element (10) toward the barrel of the weapon, whereby, after the turning stops, the movement speed is the same as that of the first transfer element (8) and, correspondingly, the projectile.

7. A transfer device as claimed in claim 1, characterised in that the transfer device is mounted in a fixed position relative to the barrel of the weapon.

8. A transfer device as claimed in claim 1, characterised in that the transfer device is mounted relative to the barrel of the weapon to be movable in transverse direction thereto so that it is movable behind the barrel for the loading of the weapon and away firm it for firing.

* * * * *